United States Patent [19]

Volpe

[11] 3,931,837

[45] Jan. 13, 1976

[54] CARRIER FOR SHUTTLELESS LOOM

[75] Inventor: Richard L. Volpe, Hopedale, Mass.

[73] Assignee: Rockwell International Corporation, Pittsburgh, Pa.

[22] Filed: Mar. 5, 1975

[21] Appl. No.: 555,548

[52] U.S. Cl. ..... 139/122 N; 139/122

[51] Int. Cl.[2] ..... D03D 47/22

[58] Field of Search ..... 139/122 R, 122 N, 123, 139/124, 127 R

[56] References Cited

UNITED STATES PATENTS

| | | | |
|---|---|---|---|
| 3,613,740 | 10/1971 | Geiger | 139/122 N |
| 3,638,686 | 2/1972 | Sole et al. | 139/122 N |
| 3,842,867 | 10/1974 | Volpe | 139/122 N |
| 3,874,420 | 4/1975 | Cugini | 139/122 N |

*Primary Examiner*—James Kee Chi

[57] ABSTRACT

An improved carrier for use on a shuttleless loom of the type in which yarn is inserted into the warp shed from a stationary source located outside of the warp and in which a free end of the previously cut warp is gripped by the inserter carrier between biased gripper finger and a yarn guide finger to carry the end to approximately the mid point between the two sides of the loom, in which the improved inserter carrier has a yarn gripping element whose axis of rotation can be spatially varied to assure accurate and uniform contact between the gripping surfaces of the pivotable gripper element and the yarn guide element.

11 Claims, 7 Drawing Figures

CARRIER FOR SHUTTLELESS LOOM

BACKGROUND OF THE INVENTION

In shuttleless looms, that is, those looms in which weft yarn is supplied from a stationary source location outside the lateral limits of the warp yarns, it is customary to insert each pick of weft by means of a reciprocating inserter or inserters. In the most common shuttleless loom operation a supply of weft is located adjacent the right hand side of the loom and each pick of weft is drawn from the source and inserted into the shed formed between the warp yarns. The insertion itself is effected by means of an inserter carrier which is moved into and from the shed by means of a reciprocating inserter. In this usual form the inserter carrier is met at approximately the center of the warp shed by an extending carrier which grasps the weft being inserted and draws it to the other side of the loom. The extending carrier is moved into and out of the shed by means of a reciprocating inserter in the same manner in which the inserter carrier is moved.

There are two basic weft insertion methods that are used in connection with looms of the type mentioned above. These weft insertion methods are the Gabler and Dewas methods and are frequently referred to as the "hair pin" and "gripper" methods respectively. In the Gabler insertion method a weft yarn end is held clamped outside of the selvedge after cutting and the inserting carrier then pulls a quantity of yarn from the yarn package so that a loop of yarn is initially formed in the warp shed. After a predetermined length of time, the clamped end is releasaed so that the extending carrier can continue to draw the looped yarn to the other side of the loom. By way of contrast the Dewas system utilizes inserting and extending carriers in which the end of the yarn is gripped by the inserting carrier and then this same gripped end is transferred to the extending carrier and drawn on to the other side of the warp.

In the gripper system for inserting weft yarns it is often necessary, or desirable, to be able to insert yarns of different qualities and thicknesses, as it is in the hair pin system. However in the gripper method it is extremely vital that the clamping elements be brought into very accurate, aligned contact so that yarn ends are not lost during a pick and thus result in interruption of loom operation. For example if a loom is working with both a coarse and a fine yarn, that is with yarns of grossly different diameters, it is obvious that a gripper inserter must be able to accommodate and positively grip the yarn of lesser diameter as well as the yarn of larger diameter. Thus it is necessary to result to complex, time consuming and, therefore, expensive machining or other costly manufacturing methods for insuring that extremely close tolerances are obtained between the clamping elements.

SUMMARY AND OBJECTS OF THE INVENTION

It is a present object of this invention to provide an improved gripper inserter element which can accommodate, conveniently, yarns of different characteristics and sizes.

Another object of this invention is to provide an improved gripper inserter element in which one of the yarn gripping elements can have its axis of rotation spatially adjusted to insure evenness of contact between the inserter gripper surfaces.

An additional object of this invention is to provide an improved yarn gripping inserter which provides a novel means for adjusting the gripping tension.

A further object of this invention is to provide an improved gripper inserter apparatus in which the tensioning means for varying gripping tension has greater life and flexibility of operation.

Other objects and advantages of this invention will be in part explained by reference to the accompanying specification and drawings in which:

DESCRIPTION OF THE PREFERRED EMBODIMENT

Figure 1:
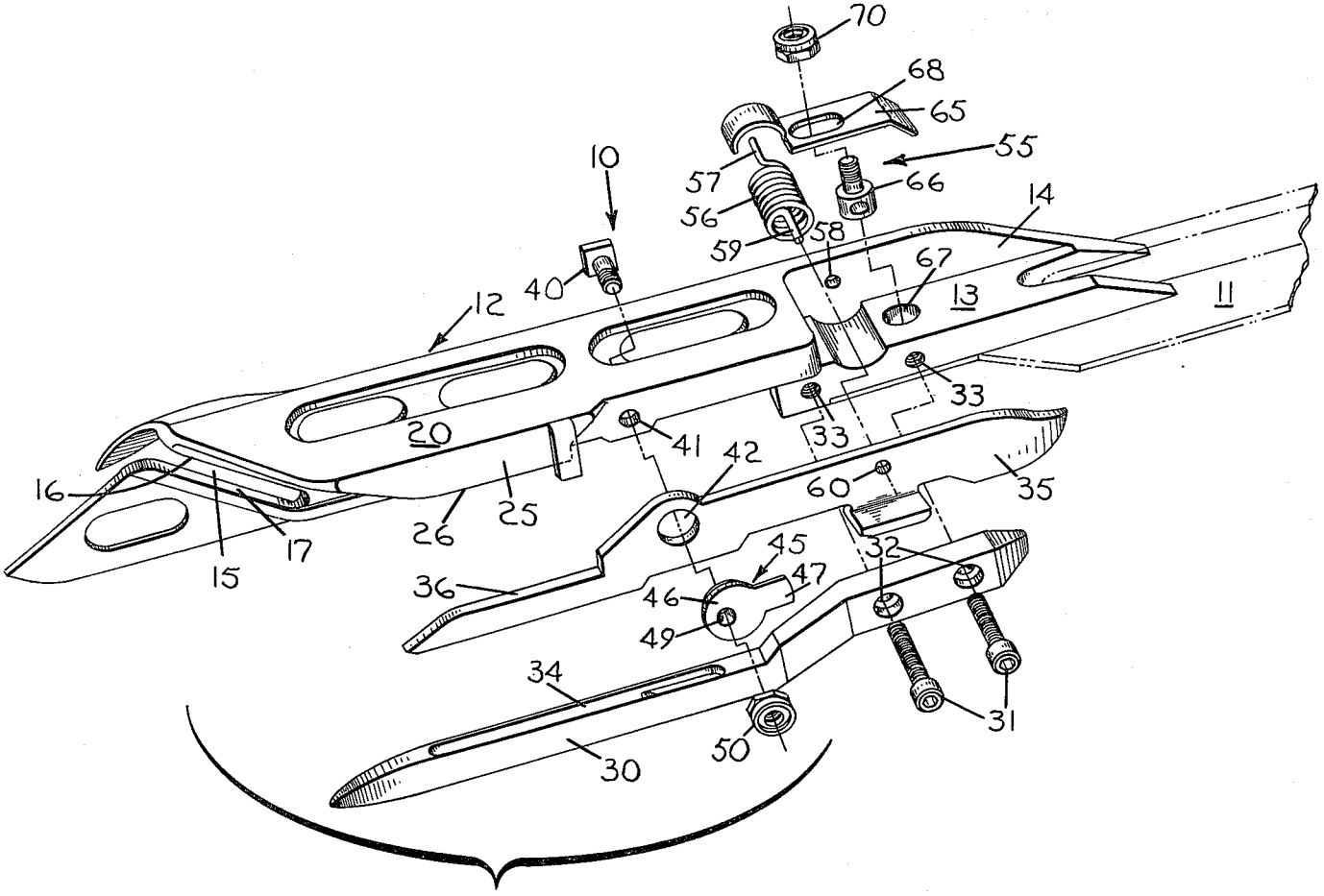
FIG. 1 is an exploded perspective view of an improved gripper weft inserter according to this invention.

As was previously mentioned it is extremely important in the gripper type of shuttleless loom that the gripping surfaces by accurately aligned so that yarns of various sizes can be gripped positively to avoid shutdown of the loom. Heretofore, to achieve accuracy of the type that is delivered by the apparatus of this invention it would have been necessary to result to time consuming and expensive machining operations. In order to better understand the construction and method of operation by which the shortcomings of the prior art are obviated, reference is made to the drawings, and specifically to FIG. 1. In this Figure numeral 10 indicates the general carrier assembly which is attached to the leading end of a reciprocating inserter 11. In this case reciprocating inserter 11 is shown as a flat flexible tape which can be wound and unwound about a tape wheel located outside of the warp shed, all in a well known manner. Other type of reciprocating inserters may also be used since the particular reciprocating inserter used is not relevent the present invention.

The improved gripper carrier 10 is comprised of a main body portion 12, which in turn includes a shank portion 12 that can be attached to the forward end of tape 11 by any suitable means, such as silver soldering, braising, etc. Main body portion 12 also includes a back wall 14 which extends outwardly from shank portion 13, at substantially right angles with respect to the upper surface of the shank portion 13. It can also be seen that back wall 14 includes means which define a yarn guide 15 that is in the form of a rearwardly sloped slot. Specifically the upper wall 16 and lower wall 17 define the limits of the yarn guide 15. This particular type of guide is normally used when it is desired to operate a loom when using yarn from a plurality of sources, as opposed to a single source. These type of yarn guides are also well known in the prior art.

A further part of main body portion 12 is an upper wall 20 that begins at the uppermost limit of back wall 14 and extends forwardly in a substantially horizontal plane from the back wall 14. This upper wall 20 is also located outwardly from the shank portion 13 and is substantially parallel with the upper surface of the shank portion. Upper wall 20 terminates in a front wall 25 that extends downwardly from the forwardmost limit of upper wall 20.

Figure 2:
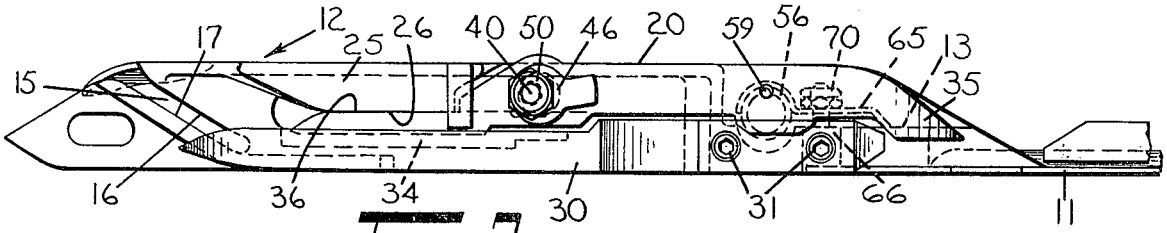
FIG. 2 is a side elevation of an improved gripper looking toward the front wall thereof.
Figure 3:
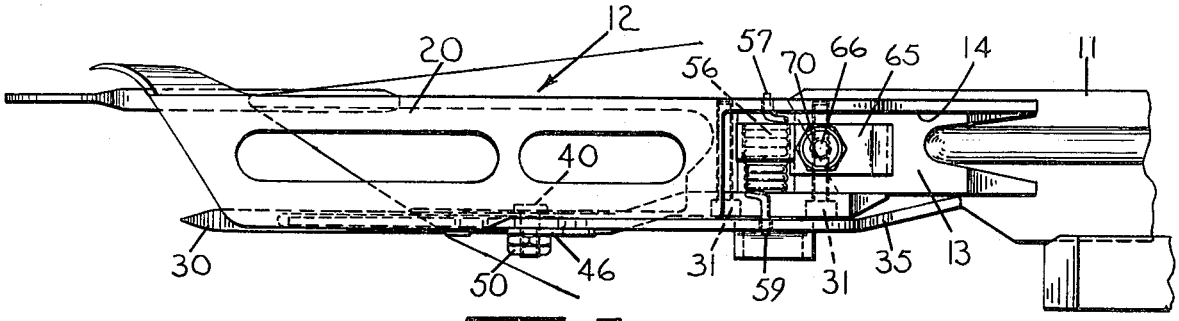
FIG. 3 is a top elevation of the improved gripper showing the positioning of a gripped yarn.
Figure 4:
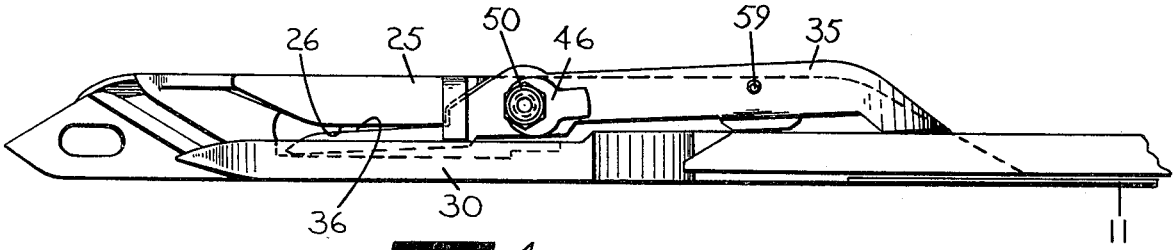
FIG. 4 is a side elevational similar to FIG. 2 with the carrier moved into the position where the gripping surfaces are opened.

From wall 25 extends downwardly from upper wall 20 a distance less that the height of back wall 14, as best seen in FIGS. 2 and 4 of the drawings. The lower terminus of front wall 25 defines a yarn gripping surface 26. That is, the bottom surface 26 defines a surface which combines with a gripper element, to be subsequently described, to engage the yarn and hold it firmly during the inserting operation.

As clearly shown in FIG. 1 of the drawings there is provided a yarn guide finger 30 that is secured at one end to the shank portion 13. Yarn guide finger 30 is attached to shank portion 13 by means of the Allen Reed screws 31 that extend through holes 32 in the yarn guide finger and on into the interiorly threaded openings 33 in the side of shank portion 13. The yarn guide finger 30 also includes a generally rectangularly shaped opening 34 in the upper surface of that portion which extends outwardly from shank portion 13 in the same direction as front wall 20. When assembled into position, the finger 30, and consequently the opening 34, are located in underlying relationship with respect to the gripping surface 26 of front wall 25.

An element essential to the yarn gripping functioning of the present improved carrier is identified in the figures by the numeral 35. This element 35 is the yarn gripper finger which has a gripper surface 36 that is adapted to cooperate with the lower yarn gripping surface 26 of front wall 25. It is these two surfaces that must be placed in accurate cooperating relationship throughout the lengths thereof if the carrier is to be capable of operating simultaneously with different varieties and sizes of yarns.

Figure 7:
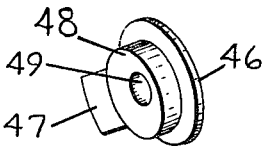
FIG. 7 is an enlarged perspective view of the gripper cam.

To achieve the necessary relationship between gripping surfaces 26 and 36, the gripper finger 35 is assembled onto the front wall 25 and provision is made for the finger 35 to pivot about an effective pivot axis which can be adjusted to be located in various spatial locations. As shown in the drawings this mounting means comprises a pivot shaft 40 that is inserted into a hole 41 in front wall 20 of main carrier body 12 and also through a larger opening 42 which extends through gripper finger 35. The location of the gripper finger 35 with respect to the front wall 25 is such that the openings 41 and 42 are in communication to permit pivot shaft 40 to extend through each of the openings. An additional element included as part of this overall mounting means is a cam 45 which is made up of a main body 46 and an outwardly extending finger 47. The main body 46 of cam 45 includes a shoulder 48 (FIG. 7) that is so proportioned as to be rotatably received into the opening 42 of the gripper finger 35. It also includes means defining an opening 49 that is located on an axis generally parallel to the axis of rotation of cam 45, but which is not concentric therewith. The final element of the assembly mechanism is a fastening member 50, which is here shown as a nut that is assembled on the threaded outer end of a pivot shaft 40.

In order that the gripper finger 35 will be biased in a direction that causes gripper surface 36 to be urged against gripper surface 26, there is provided adjacent that end of the gripper finger 35 nearest to shank portion 13 a biasing means that is operatively connected to the gripper finger. The biasing means has been indicated generally by the numeral 55 and comprises a biasing element which is here shown as a coil spring 56, the coil spring having one end secured to the back wall 14 by inserting it into the opening 58. The other end, 59, of spring 56 is secured to the gripper finger 35 by inserting it into the opening 60.

The pressure that is present to urge the gripping surface 36 of gripper finger 35 toward the yarn gripping surface 26 of front wall 25 can be varied by means of an arrangement whereby tension in the coil spring 56 can be altered. Referring to the drawings there is provided a clamp 65 which has a rounded or generally arcuately shaped portion that receives a portion of the body of spring 56. Clamp 65 is held in position on the shank portion 13 of main body 12 by means of a bolt 66 that extends upwardly through an opening 67 in the shank portion 13. The upper end of bolt 66 extends through the slotted opening 68 in clamp 65 so that the nut 70 can be threaded thereon. Thus after spring 56 is secured to the back wall 14 and to the gripper finger 35 the clamp 65 is drawn down to exert more or less pressure against the coiled body portion of the spring, as desired. This pressure exerted against the body varies the tension exerted against it and thus, in turn results in a change in the amount of pressure that finger 35 can exert against the gripping surface of front wall 25.

Figure 5:
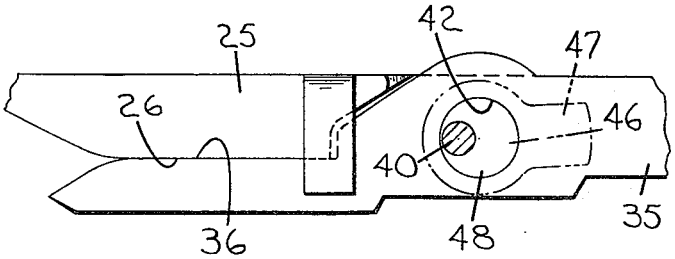
FIG. 5 is a somewhat enlarged fragmentary side elevation showing the gripper adjusting cam in the position that causes alignment between gripping surfaces.
Figure 6:
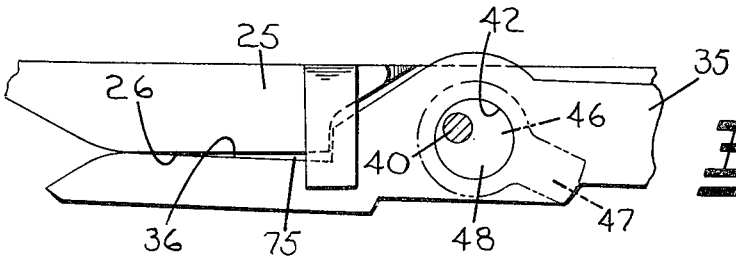
FIG. 6 is a view similar to FIG. 5 showing the cam in a position causing disalignment between gripping surfaces.

To explain the general functioning or operation of the present invention, a gripper carrier is assembled in accordance with the preceeding discussion. The tension exerted against spring 56 can be roughly approximated from knowledge of the type of weft yarn that is to be inserted into the warp shed. Obviously this tension can be adjusted to be either greater or smaller circumstances require. The operator then determines whether or not there is continuous, unbroken contact between the surface 36 and 26 (as for example shown in FIG. 5) or whether there exists a gap, as indicated by the numeral 75 in FIG. 6. If these surfaces are not completely mating then the operator loosens the fastener 50 on pivot shaft 40 and rotates the cam 45 in the direction necessary to bring surfaces 26 and 36 into the mating engagement illustrated in FIG. 5. Since the axis of pivot shaft 40 is parallel to the axis of rotation of cam 45, but is not concentric therewith, rotation of the cam will cause a spatial relocation of the axis of rotation of the gripper finger 35. It is this change of location of the pivot axis of gripper finger 35 that makes possible the relative alignment between gripping surfaces 26 and 36. After alignment of the gripping surface has been accomplished the carrier is ready for use.

Although the present invention has been described in connection with preferred embodiments, it is to be understood that modifications and variations may be resorted to without departing from the spirit and scope of the invention as those skilled in the art will readily understand. Such modifications and variations are considered to be within the purview and scope of the invention and the appended claims.

I claim:

1. An improved carrier for inserting weft yarn into the shed formed between warp yarns on a loom of the type in which the weft yarn is supplied from a source located outside of the warp and is inserted into the shed by a carrier which is attached to a reciprocating inserter, said improved carrier, comprising:

1. a main body portion which includes:
   a. a shank portion for attachment to the reciprocating inserter,
   b. a back wall extending outwardly from said shank portion, said back wall including means defining a yarn guide,
   c. a top wall extending forwardly from said back wall,
   d. a front wall extending downwardly from said top wall a distance less than the height of said back wall, and
   e. a yarn gripping surface on the bottom surface of said front wall,
2. a yarn guide finger secured at one end to said shank portion and extending outwardly therefrom in the same direction as said front wall and located in underlying relationship with respect to said gripping surface thereon;
3. a gripper finger having a gripping surface for cooperation with said yarn gripping surface on said front wall,
4. means mounting said gripper finger on said front wall for rotation about a pivot axis wherein said means provides for variation in the spatial location of the pivot axis, and
5. a biasing means for urging said gripper finger into gripping contact with said yarn gripping surface.

2. An improved carrier as defined in claim 1 wherein said biasing means is a coil spring having one end attached to said back wall and one end connected to said gripper finger.

3. An improved carrier as defined in claim 1 wherein said biasing means can be adjusted to change the force urging the gripping surface of said gripper finger toward the yarn gripping surface of said front wall.

4. An improved carrier as defined in claim 2 wherein means is provided to compress said spring in a direction substantially parallel to the radii of the coils thereof.

5. An improved carrier as defined in claim 4 wherein said spring compressing means comprises a claim member that is adjustable attached to said shank portion of said main body member.

6. An improved carrier as defined in claim 1 wherein said front wall and said gripper finger have means defining openings therethrough which are so located as to communicate, a pivot shaft extending through said openings, cam means mounted within said opening in said gripper finger for rotation about an axis parallel to but not coaxial with the axis of rotation of said pivot shaft and having means defining an opening to receive said shaft of rotation whereby rotation of said cam means will vary the spatial location of the axis of said pivot shaft.

7. An improved carrier as defined in claim 1 wherein said means mounting said gripper finger for rotation includes:

1. a pivot shaft extending outwardly from said front wall,
2. means including a cam having an opening for receiving said pivot shaft, said cam being mounted within said gripper finger for rotation about an axis parallel to but not concentric with the axis of said pivot shaft.

8. An improved carrier as defined in claim 7 wherein said cam has:

1. a main body and
2. an adjusting finger extending outwardly therefrom.

9. As improved carrier as defined in claim 7 wherein means are provided for locking said cam in a preselected position.

10. An improved carrier as defined in claim 7 wherein said biasing means is a coil spring having one end to said back wall and one end attached to said gripper finger.

11. An improved carrier as defined in claim 10 wherein the tension in said coil spring can be adjusted.

* * * * *